US005398869A

United States Patent [19]

Dickson et al.

[11] Patent Number: 5,398,869

[45] Date of Patent: Mar. 21, 1995

[54] DISPLAY-READY SHIPPING CARTON

[75] Inventors: Dane Dickson, Pleasanton; Ronald E. Heiskell, Tracy; Ezra E. Theys, San Mateo; Michael J. Silveira, Concord; Frank M. Knafelc, Lafayette; Larry F. Morice, San Ramon, all of Calif.

[73] Assignee: The Clorox Company, Oakland, Calif.

[21] Appl. No.: 971,441

[22] Filed: Nov. 3, 1992

[51] Int. Cl.[6] ..... B65D 5/54; B65D 5/42

[52] U.S. Cl. ..... 229/162; 206/45.31; 229/915

[58] Field of Search ..... 279/23 R, 162, 915, 279/918, 919, DIG. 2, DIG. 5, DIG. 11; 206/45.31

[56] References Cited

U.S. PATENT DOCUMENTS

| | | | |
|---|---|---|---|
| 1,665,620 | 4/1928 | Amatel . | |
| 1,912,952 | 6/1933 | Scruby | 229/162 |
| 2,097,858 | 11/1937 | Herz | 229/162 |
| 2,126,106 | 8/1938 | Goldberg | 229/162 |
| 2,180,691 | 11/1939 | Olivier | 206/44 |
| 2,242,711 | 5/1941 | Olivier | 229/162 |
| 2,423,332 | 7/1947 | Mayer | 229/15 |
| 2,473,766 | 6/1949 | Richey | 229/42 |
| 2,900,120 | 8/1959 | Wichman | 229/15 |
| 2,925,209 | 2/1960 | Wasyluka | 229/15 |
| 2,944,727 | 7/1960 | Moore | 229/162 |
| 3,209,979 | 10/1965 | Ziegfeld | 229/15 |
| 3,348,667 | 10/1967 | Beeby | 206/45.33 |
| 3,434,648 | 3/1969 | DuBarry Jr. | 229/23 R |
| 3,480,196 | 11/1969 | De Simas | 229/23 |
| 3,664,494 | 5/1972 | Mergens | 206/44 |
| 3,669,251 | 6/1972 | Phillips, Jr. | 206/44 |
| 3,702,170 | 11/1972 | Adams | 229/15 |
| 3,709,425 | 1/1973 | Stapp | 206/45.31 |
| 3,749,235 | 7/1973 | Boursier | 206/45.31 |
| 3,770,186 | 11/1973 | Kupersmit | 229/23 |
| 3,786,914 | 1/1974 | Beutler | 206/44 |
| 3,850,362 | 11/1974 | Stollberg et al. | 229/23 R |
| 3,858,526 | 1/1975 | Lombard et al. | 108/51 |
| 3,870,221 | 3/1975 | Zeitter | 229/162 |
| 3,946,883 | 3/1976 | Beal | 214/152 |
| 3,949,874 | 4/1976 | Heavner | 206/386 |
| 3,961,706 | 6/1976 | Roccaforte et al. | 206/44 |
| 4,011,943 | 3/1977 | Galli et al. | 206/44 |
| 4,040,559 | 8/1977 | Giebel | 229/23 R |
| 4,053,098 | 10/1977 | Baptist | 229/23 R |
| 4,201,138 | 5/1980 | Cox | 108/55.1 |
| 4,251,020 | 2/1981 | Schwaner | 229/15 |
| 4,335,842 | 6/1982 | Bradford et al. | 229/15 |
| 4,363,405 | 12/1982 | Christie | 206/554 |
| 4,382,504 | 5/1983 | Vesborg | 206/44 |
| 4,497,408 | 2/1985 | Jes | 229/23 R |
| 4,574,945 | 3/1986 | Giblin | 206/44 |
| 4,635,795 | 1/1987 | DeFlander et al. | 206/526 |
| 4,641,746 | 2/1987 | Dornbusch et al. | 206/44 |
| 4,697,699 | 10/1987 | Schneider | 206/44.11 |
| 4,705,162 | 11/1987 | Kupersmit | 206/45.11 |
| 4,793,494 | 12/1988 | Gordon, Jr. | 229/23 R |
| 4,865,187 | 9/1989 | Zulauf et al. | 229/162 |
| 4,953,702 | 9/1990 | Bryan | 206/432 |
| 5,048,690 | 9/1991 | Zimmerman | 206/602 |
| 5,145,060 | 9/1992 | Maye | 206/45.14 |

FOREIGN PATENT DOCUMENTS

| | | | |
|---|---|---|---|
| 763770 | 12/1956 | United Kingdom | 206/45.31 |

*Primary Examiner*—Gary E. Elkins

*Attorney, Agent, or Firm*—John A. Bucher; Harry A. Pacini

[57] ABSTRACT

Multiple embodiments of a display-ready carton each include an opening formed in one vertical panel both to display articles within the carton and to permit their removal as desired. The opening preferably extends into the top panel of the carton and includes a removable reinforcing element, more preferably a T-bar, extending across the opening. The carton is preferably formed from corrugated material having a horizontal axis of corrugation in the panel forming the opening and a vertical axis of corrugation in the end panels to structurally rigidify the carton. The carton is preferably the same height as the articles and is more preferably formed from a wrap including the front, back, top and bottom panels and end pieces forming the two end panels. In a method of use, the carton is filled with articles, transported to a point of sale and then arranged to display articles in the carton, the removable reinforcing element more preferably being removed after the carton is filled with articles and prior to display of the articles to make the carton fully display-ready.

17 Claims, 5 Drawing Sheets

DISPLAY-READY SHIPPING CARTON

FIELD OF THE INVENTION

The present invention relates to an improved packing carton and method of use and more particularly to such an improved packing carton and method of use wherein the carton is display-ready.

BACKGROUND OF THE INVENTION

Shipping cartons of the type contemplated by the present invention are commonly employed both for transport and display of articles transported within the cartons. The articles may be any of a wide variety but typically are household products such as liquid containers.

The use of cartons for both transport and display at a point of sale of the same articles is particularly common in warehouse clubs and the like where large volumes of similar articles are displayed for sale. In such operations, it is common to transport large numbers of the articles in cartons on pallets with the palletized cartons forming a display for the articles at the point of sale in the warehouse type operation.

Where the articles being transported and displayed are relatively heavy, formation of the cartons in a display-ready mode during both transport and subsequent display becomes relatively difficult because of the need for assuring structural rigidity of the cartons. This is particularly true, for example, where the cartons are stacked upon each other on a pallet as described above. In such instances, the formation of an opening in the carton to facilitate display of the articles within the carton and to permit their removal from the carton as desired tends to interfere with structural rigidity or integrity of the carton, particularly during transport.

For this reason, many shipping cartons tend to form a complete enclosure for the articles at least during transport. When the cartons reach the point of sale, they are then prepared for display, for example, by removing a cover, by removing panels or by folding or otherwise disposing of panels in order to facilitate display of the articles within the cartons and to permit their ready removal by consumers or the like as desired.

This tends to create a problem because of the need for preparing the cartons for display at the point of sale. In addition to the effort required to prepare the cartons, there is also a problem of disposing of the covers or panels removed from the cartons. In addition, where the cartons are shipped in stacked arrangement on pallets, it is either necessary to unstack the cartons and prepare each of them for display and removal of articles within the cartons or to prepare successive tiers of cartons as articles are removed from the upper tiers of cartons.

Accordingly, such prior art cartons are generally undesirable because of the additional effort required to prepare them for display at the point of sale and also to dispose of any covers or panels removed from the cartons. In addition, it is of course undesirable to require additional effort to prepare layers or tiers of the cartons during continued display of the articles in cartons arranged for example upon a pallet. One type of carton employed in applications such as those contemplated by the present invention are formed from three elements including a "wrap" and two separate end panels. In such a carton configuration, the wrap forms both front and rear panels as well as a bottom panel. Fold lines are commonly provided within the wrap to facilitate erection of the wrap to form the carton. Major flaps are commonly formed on both ends of the wrap and arranged for overlapping relation to form a top panel of the carton. Additional minor flaps are formed on both the wrap and end panels in order to interconnect the end panels with the wrap, commonly by applying hot glue to the flaps on the wrap. The end pieces also include flaps designed for forming triangular support structures in the four vertical corners of the formed carton, extending between the top and bottom panels.

Other types of cartons are of course contemplated by the present invention and the preceding description is provided only for further clarification.

It has also become common practice to arrange large number of cartons on pallets as noted above for both transport to the point of sale and for display. Particularly where the cartons contain relatively heavy articles such as liquid containers, the number of cartons stacked one upon the other is relatively limited. Typically, where the articles are one gallon liquid containers, it may be common to stack the cartons only three-high on the pallets.

With the cartons arranged upon the pallet prior to transport, they are commonly wrapped together with the pallet by means of transparent stretch-wrap. However, it is noted that other devices such as bands may also be employed to stabilize the cartons on the pallets.

With the cartons stabilized on the pallets as described above, they can more readily be transported to the point of sale. The stretch-wrap or bands are then readily removed at the point of sale and present only a limited amount of material for disposal. However, with the prior art cartons as noted above, substantial additional effort is required to further condition the individual cartons for display of articles contained therein and removal of the articles as desired.

SUMMARY OF THE INVENTION

Accordingly, there has been found to remain a need for further improvements in cartons employed for both transport and display of goods. In particular, there has been found to remain a need for cartons which are fully "display-ready" whereby the cartons are substantially ready for display upon arrival at the point of sale. As noted above, minimum effort may be required to remove stretch-wrap or bands employed to secure the cartons in place upon a shipping pallet or the like.

Accordingly, it is an object of the invention to provide an improved packing carton and method of use wherein the carton is display-ready during transport, thereby permitting the carton to be immediately converted to a display mode and permitting articles to be removed from the carton or cartons immediately upon arrival at a point of sale.

It is a further object of the invention to provide an improved packing carton of a type including a wrap and two separate end pieces forming end panels for the carton, the wrap including a front panel forming an opening for the display of articles contained in the carton and permitting removal of articles from the carton as desired, the wrap being formed from corrugated material having a horizontal axis of corrugation in the carton and the two end pieces also being formed from corrugated material having a vertical axis of corrugation in the carton to enhance structural rigidity of the carton.

Preferably, the carton includes a removable reinforcing element in the opening the opening more preferably extending into the top panel of the wrap with the removable reinforcing element more preferably including a horizontally extending bar portion and a bar portion extending vertically through the opening in the front panel and continuing through the opening extension in the top panel.

It is yet a further object of the invention to provide a display-ready carton suitable for both transport and display of articles in the carton, the carton including triangular means arranged in each of four vertically extending comers to provide structural rigidity, one vertical panel of the carton forming a central opening for displaying and facilitating removal of articles and end portions on both lateral sides of the opening for respective interconnection with two of the triangular means in order to enhance structural rigidity whereby the carton is suitable for transport in a display-ready mode.

It is a still further related object of the invention to provide a method of forming and using a display-ready carton having an opening in one vertical panel and a removable reinforcing element extending across the opening, the method including the steps of filling the carton with articles, transporting the articles in the carton to a point of sale, displaying the articles for sale in the carton and removing the reinforcing element from the opening in the vertical panel after the carton is filled with articles and prior to displaying the articles in the carton.

It is an even further object of the invention to provide a display-ready carton suitable for both transport and display of articles in the carton with one vertical panel of the carton forming a central opening for displaying and facilitating removal of articles, end portions on both lateral sides of the opening and a bottom portion below the opening to form an integral fold with the bottom panel of the carton, the carton being formed from corrugated material with the one vertical panel having a horizontal axis of corrugation and the two end panels having vertical axes of corrugation in order to enhance structural rigidity and make the carton suitable for transport in a display-ready condition.

In connection with each of the objects set forth above, it is further contemplated that the carton have an interior height approximately equal to the height of articles transported and displayed therein so that the articles further enhance structural rigidity of the carton.

Additional objects and advantages of the invention are made apparent in the following description having reference to the accompanying drawings.

DESCRIPTION OF THE PREFERRED EMBODIMENTS

Figure 1:
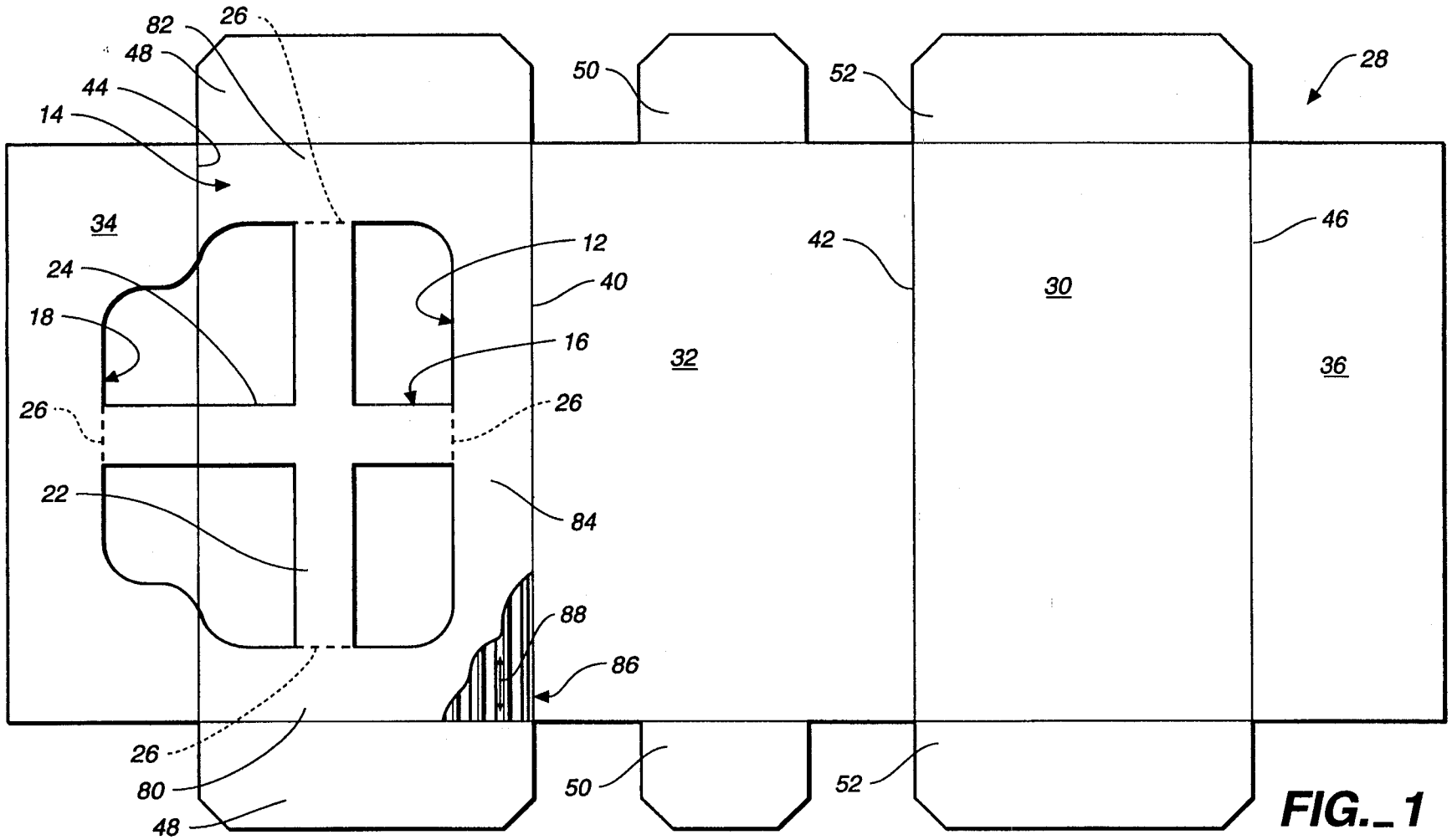
FIG. 1 is a plan view of a wrap forming the front, rear and bottom panels with flaps for forming a top panel of the carton.

Referring now to the drawings and particularly to FIGS. 3–6, the present invention is directed toward a "display-ready" carton suitable for both transport and display of articles, the carton of the invention requiting little or no alteration upon completion of transport and arrival at a point of sale to convert it to a display mode.

Figure 3:
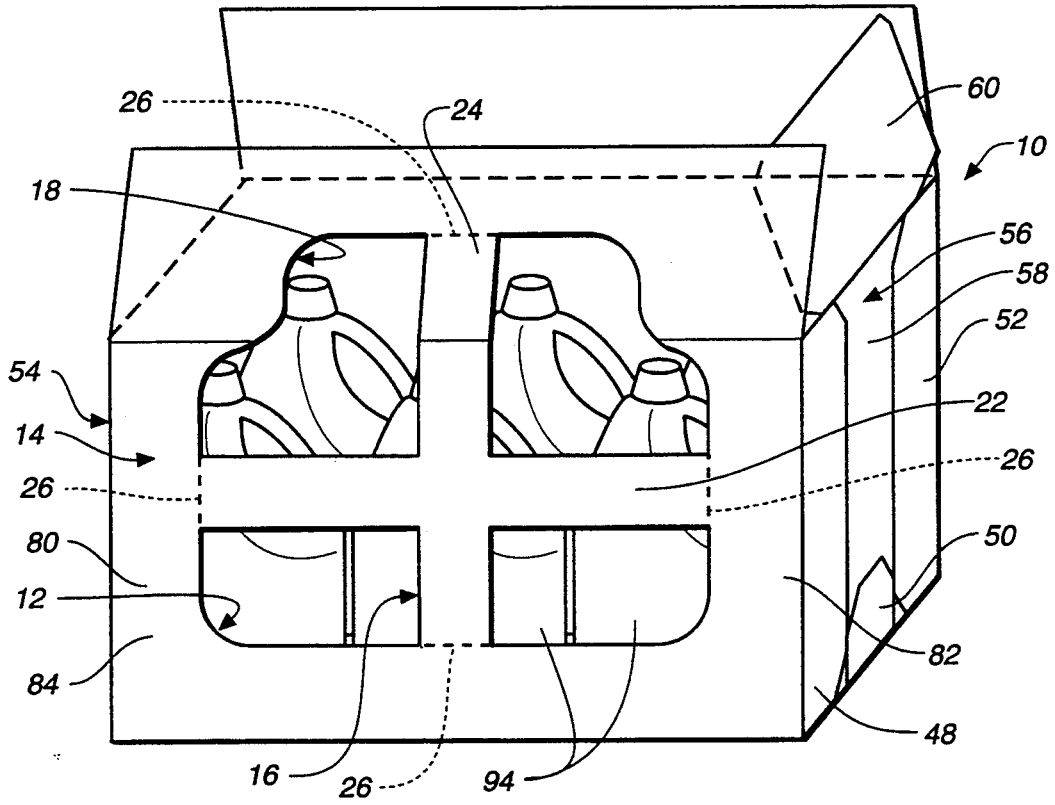
FIG. 3 is a view of a carton assembled from the wrap and two end pieces of FIGS. 1 and 2, the carton being filled with articles through its open top.
Figure 6:
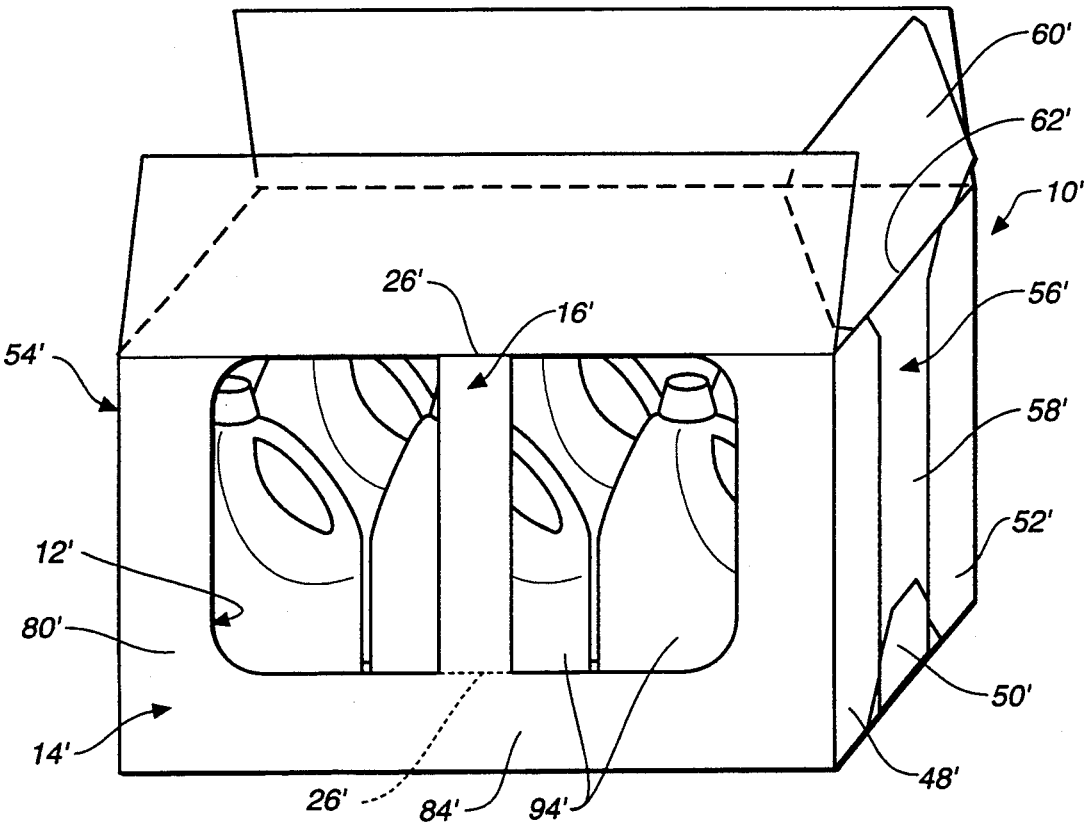
FIG. 6 is a view of another embodiment of a carton with an opening formed only in a single vertical panel of the carton, FIGS. 4 and 5 also illustrating the alternate embodiment of FIG. 6 after the carton is closed.

Different embodiments of such a carton are indicated at 10 and 10' respectively in FIGS. 3 and 6. In view of the similarity between the two embodiments, corresponding components in the embodiment of FIG. 6 are indicated by primed numerals similar to those described below in connection with FIG. 3.

The carton 10 of FIG. 3 forms an opening 12 in a front vertical panel 14. Preferably, the vertical panel 14 extends along the longer horizontal dimension of the carton. A similar opening 12' is formed in the front vertical panel 14' in the carton 10' of FIG. 6.

A removable reinforcing element 16 or 16' extends across the openings 12 or 12' of the cartons 10 and 10'.

However, the opening 12 in the front panel 14 of FIG. 3 includes an opening extension 18 in a top panel 20 of the carton. In the embodiment 10' of FIG. 6, only the opening 12' is formed in the front panel 14' with no opening extension in the top panel 20'.

In both embodiments, the removable reinforcing element 16 or 16' extends across the opening 12 or 12' in the front vertical panel 14 or 14'. However, in the carton 10 of FIG. 3, the removable reinforcing element 16 includes a portion 22 extending horizontally across the opening 12 in the front panel 14 and a vertical section 24 extending vertically through the opening 12 and continuing through the opening extension 18 in the top panel 20. Accordingly, the removable reinforcing element 16 in the carton 10 is preferably formed as a cross or "T-bar". However, other configurations would also be possible.

In the carton 10' of FIG. 6, the removable reinforcing element 16' is formed generally as a single vertical bar extending vertically through the opening 12'.

The removable reinforcing elements 16 and 16' in the cartons 10 and 10' could include a variety of configurations according to the present invention. Furthermore, both of the removable reinforcing elements 16 and 16' are preferably formed from the same blank as the front vertical panel 14 or 14' and other integral portions of the carton. For example, the removable reinforcing elements 16 and 16' could be defined only by perforations 26 or 26' formed along the contour of the openings 12 or 12'.

In this manner, the reinforcing elements 16 and 16' serve their function of structurally stabilizing the cartons 10 or 10' particularly during forming and filling of the cartons so that they then function as if there were no opening. Thereafter, the perforations 26 or 26' facilitate removal of the reinforcing elements in order to make the cartons fully display-ready.

As will also be noted in the method of use described below, the reinforcing elements 16 or 16' may preferably be removed from the carton after the carton is fully assembled and prior to transport so that the carton arrives at a point of sale in a fully display-ready condition. However, the invention also contemplates that the reinforcing elements 16 or 16' could be left in place within the opening 12 or 12' until the carton actually reaches the point of sale. Thereafter, the reinforcing element could readily be removed in order to simply and immediately convert the carton to a fully display-ready condition. In either case, the carton is considered display-ready during transport and upon its arrival at a point of sale.

Figure 2:
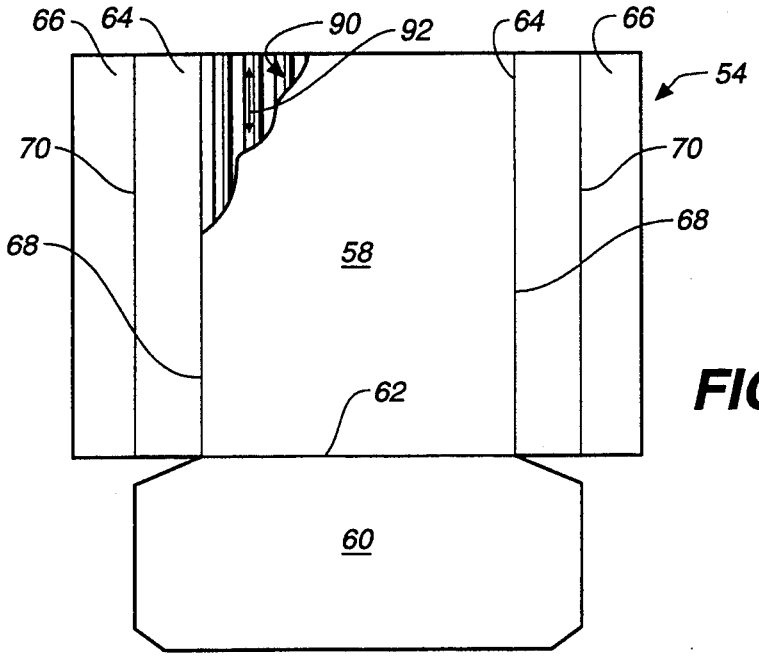
FIG. 2 is a plan view of one of a pair of end pieces, the two end pieces being mirror images of each other for forming the end panels of the carton.

Additional features of the carton 10 are described with additional reference to FIGS. 1 and 2. Preferably, the carton 10 is formed from a single wrap 28 forming the front vertical panel 14 as well as a rear vertical panel 30 and a bottom panel 32. The wrap 28 also includes major flaps 34 and 36 at opposite ends so that when the wrap is folded the major flaps 34 and 36 overlap to form the top panel 20 for the carton (see FIG. 4).

The wrap 28 also has fold lines formed between the various panels and flaps. For example, fold lines 40 and 42 are formed between opposite sides of the bottom panel 32 and the respective front and rear panels 14 and 30. Similar fold lines 44 and 46 are formed respectively between the front panel 14 and major flap 34 at between the rear panel 30 and the major flap 36.

Three tabs 48, 50 and 52 are formed at either end of the front panel 14, the bottom panel 32 and the rear panel 30 for overlapping interconnection with the end panels of the carton as described in greater detail below.

Figure 4:
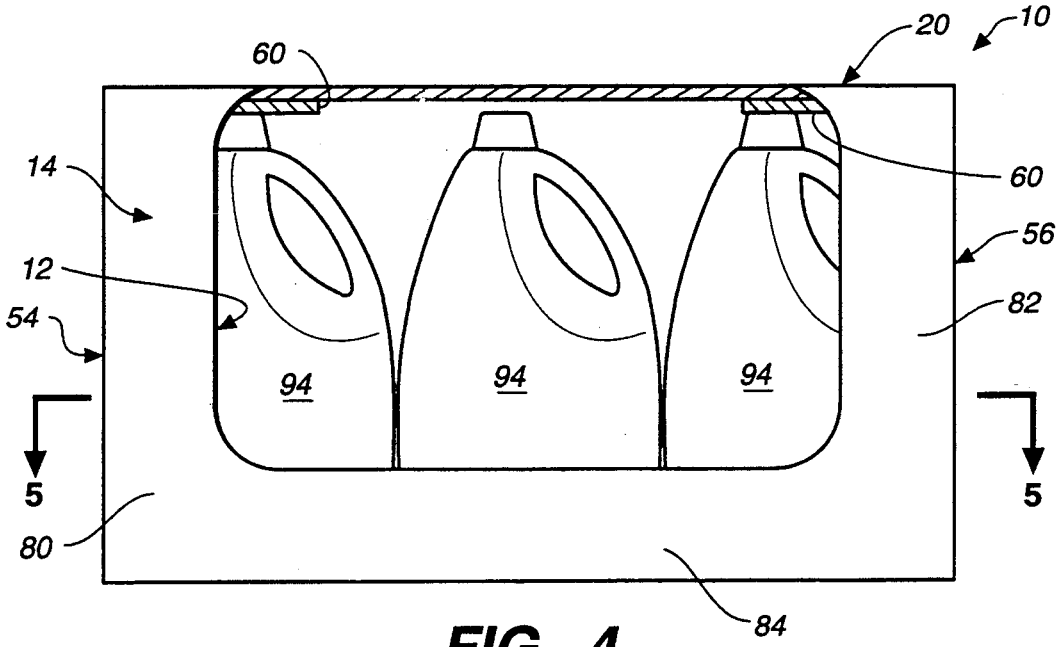
FIG. 4 is a front view of the completed carton with the top closed and forming an opening for display and removal of articles.
Figure 5:
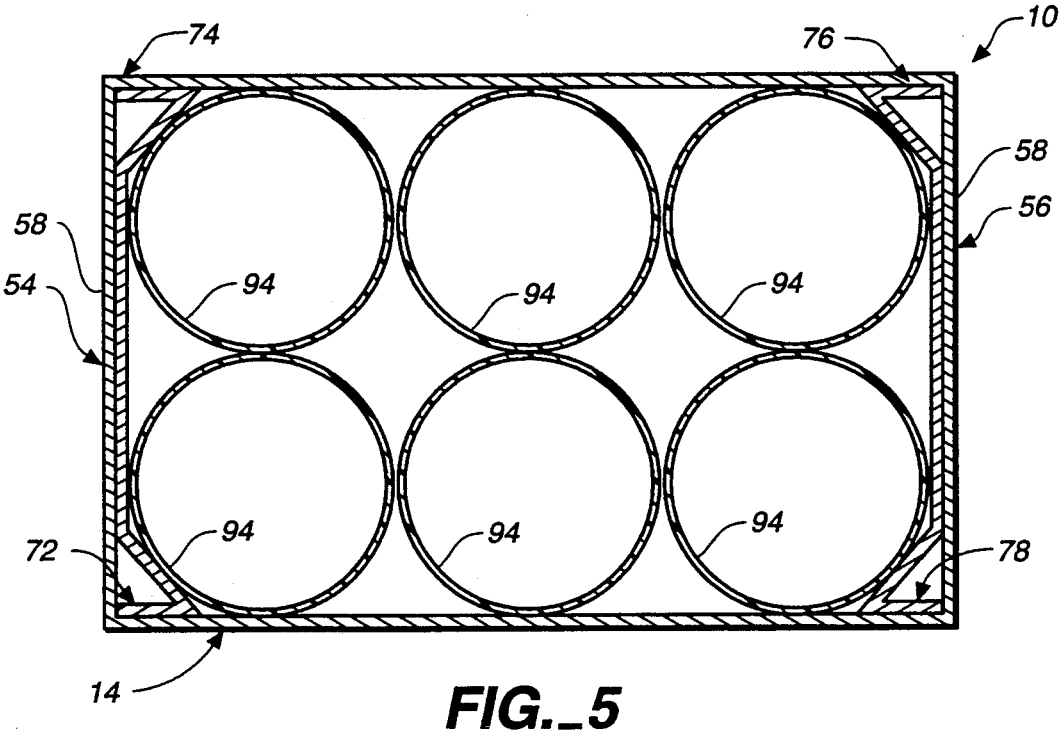
FIG. 5 is a view taken along section line V—V of FIG. 4 to illustrate internal features of construction such as triangular supports.

One end piece 54 is illustrated in FIG. 2 with a second end piece 56 being of similar but mirror image construction for completing the carton as indicated in FIGS. 3–5.

The end piece 54 includes a central panel 58 and a minor flap 60 separated from the central panel 58 by a fold line 62. Two additional small segments 64 and 66 are formed on each side of the central panel 58 by sequential fold lines 68 and 70 to form triangular supports or structures as described in greater detail below. The fold lines 68 and 70 may be perforated or scored if desired to facilitate formation of the triangular structures.

In forming the carton 10 of FIG. 3, all of the fold lines in the wrap 28 and end pieces 54 and 56 are bent at approximately right angles except for the fold lines 68 and 70 which form triangular support structures indicated respectively at 72, 74, 76 and 78 in FIG. 5.

With the carton 10 being formed from the three elements illustrated in FIGS. 1 an 2, the carton is commonly assembled by a conventional machine applying hot glue to the flaps on the wrap 28. The adjacent tabs 48, 50 and 52 are then secured to one of the end pieces 54 or 56 as illustrated in FIG. 3. The flaps 60 on the end pieces 54 and 56 are secured to the major flaps 34 and 36 which, as noted above, overlap to form the top panel 20 of the carton. The small end panels 66 on the end pieces 54 and 56 are secured or interconnected to the adjacent vertical panel, that is, either the front panel 14 or the rear panel 30 in order to form the triangular structures 72–78 as illustrated in FIG. 5.

Returning again to the opening 12 formed in the front panel 14, it is noted that the opening is smaller than the area of the panel 14 in order to leave lateral portions 80 and 82 on opposite sides of the front panel and a bottom portion 84 extending beneath the opening 12. As noted above, the opening 12 is sufficiently large in order to facilitate display of articles within the container and also to permit removal of articles from the container as desired. However, the opening 12 is also preferably sized in order to form the two end portions 80 and 82 and the bottom portion 84 noted above. The purposes for the end portions 80, 82 and the bottom portion 84 are described immediately below.

Initially, the end portions 80 and 82 are preferably sized to be sufficiently large to form a surface for interconnection with the small segments 64 and 66 on the end pieces 54 and 56 respectively. Thus, the end portions 80 and 82 are essential in order to provide sufficient rigidity within the triangular supports or structures 72–78.

At the same time, the bottom portion 84 of the front panel is integrally formed with the bottom panel 30 of the carton so that they integrally form the fold line 40 when the carton is completed as illustrated in FIGS. 3–5.

At the same time, the opening extension 18 is preferably formed in the top panel 20 primarily to enhance display of articles within the container and to further facilitate their removal as noted above. The opening extension 18 is preferably formed within the major flap 34 as illustrated in FIG. 1. The dimension of the opening extension 18 across the smaller dimension of the flap 34 is selected so that the opening extension 18 does not overlap the other flap 36. At the same time, the dimension of the opening extension 18 along the longer dimension of the flap 34 is similarly selected so that the opening extension 18 does not overlap the minor flaps 60 on the two end pieces 54 and 56. As noted above, the minor flaps 60 are secured or interconnected, preferably by hot glue, to the overlapping major flaps 34 and 36 to form the top panel 20 of the carton.

Thus, the end portions 80 and 82 as well as the bottom portion 84 on the front vertical panel 14 provide substantial structural support within the completed carton 10.

It is also to be noted that the opening 12 in the front panel 14 tends to reduce structural rigidity or strength of the carton particularly to the extent that the vertical panels of the carton provide stacking strength in the carton. In this regard, stacking strength is generally necessary in order to facilitate stacking of the cartons one upon the other. This in turn is particularly important when the cartons are employed for relatively heavy articles including one gallon liquid containers for example.

At the same time, structural rigidity of all panels within the carton are important during initial assembly of the carton and filling the carton with articles. In some instances, there was observed to a possibility of buckling within certain of the carton panels, particularly before the carton was filled with articles. The presence of the opening 12 within the front panel 14, although essential for purposes of the present invention, also serves to limit structural strength of the front panel. The limiting effect of the opening 12 upon structural strength of the front panel 14 is at least partially eliminated by means of the removable reinforcing elements 16.

However, the invention further contemplates additional features for even further enhancing structural strength or rigidity within the carton 10. In particular, the carton 10 is contemplated as being formed from corrugated material. Such corrugated material is commonly formed with linearly extending peaks and valleys which provide substantial compression resistance or strength within the material. For purposes of the present invention, such corrugated material is defined to have an axis of corrugation extending parallel to the linearly extending peaks and valleys in the material. These features of corrugated material are described below with reference to the wrap 28 and end pieces 54 and 56.

As noted above, structural strength is provided for the carton by arranging corrugated material indicated at 86 in the wrap 28 to have an axis of corrugation indicated at 88 extending horizontally across the carton or parallel to the fold line 40 formed between the front panel 14 and the bottom panel 32. With the wrap 28 being of integral construction, the remaining panels or flaps formed by the wrap 28 similarly have an axis of corrugation extending parallel to that in the front panel 14.

At the same time, the end pieces 54 and 56 are also formed from corrugated material indicated at 90 in FIG. 2. The corrugated material 90 is arranged in the end pieces 56 and 58 to have its axis of corrugation 92 arranged vertically or parallel to the fold lines 68 and 70 for the small segments 64 and 66 forming the triangular supports 72–78.

The horizontal axis of corrugation 88 in the wrap 28 and particularly within the front panel 14 is selected to provide structural reinforcement for the front panel in view of a portion of the panel being removed to form the opening 12. More specifically, the horizontal axis of corrugation 88 in the front panel 14 cooperates with the fold line 40 integrally formed by the bottom panel 32 and the bottom portion 84 of the front panel to provide structural strength along the longer dimension of the front panel 14. Structural strength in this direction is of course also formed in the other panels and flaps formed by the wrap 28, particularly the major flap 34 forming the opening extension 18.

The vertical axis of corrugation 92 within the end pieces 54 and 56 functions in combination with the vertically arranged triangular structures 72–78 in order to provide structural strength in a vertical direction in each end of the carton. As noted above, such vertical structural strength is particularly important to assure stacking strength for the carton, especially when the carton is filled with relatively heavy articles.

Also especially noting use of the carton for heavy articles such as liquid containers, the invention further contemplates that the internal height of the carton formed by the smaller dimension of the front panel 14 and rear panel 30 as well as the corresponding dimensions of the central panels 58 in the end pieces 54 and 56 is approximately the same as the height of the articles contained within the carton. Referring to FIGS. 3–6, the cartons are illustrated with articles 94 being one gallon liquid containers. Referring specifically to FIG. 4, it may be seen that the interior height of the carton is essentially similar to the height of the articles 94 as illustrated therein. Thus, the articles 94 themselves preferably serve to further enhance vertical structural rigidity and stacking strength within the cartons 20. Alternatively, separate corrugated inserts or the like could be used for a similar purpose.

Figure 7:
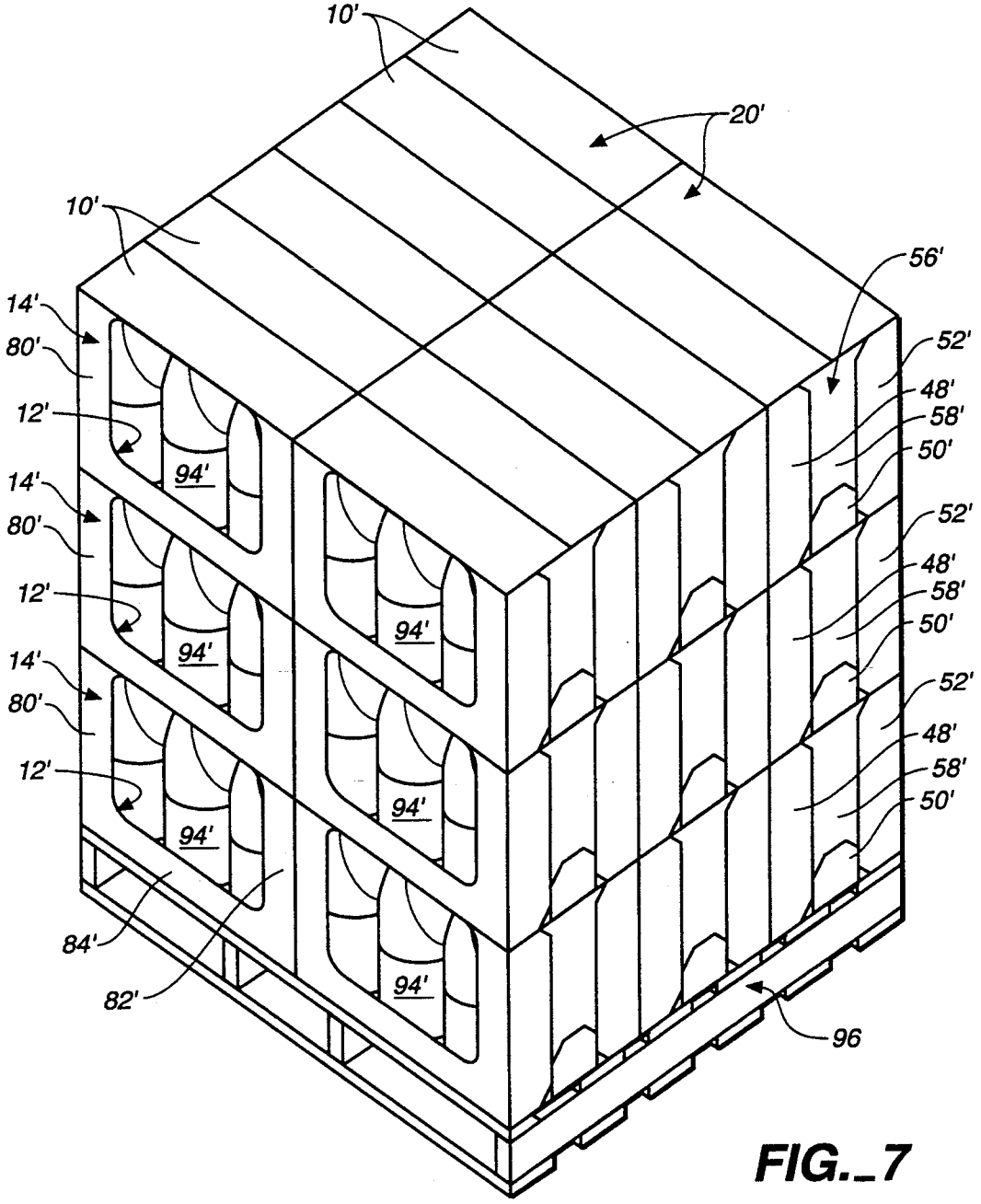
FIG. 7 is a pictorial representation of a number of cartons according to the alternate embodiment of FIG. 6 and arranged in stacked relation upon a pallet suitable for both transport and display.

It is noted again that the carton 10' in FIG. 6 includes most of the same features described above except for the opening extension 18 in its top panel 20' (also see FIG. 7). Accordingly, the carton 10' also includes the same features and the resulting benefits discussed above.

The carton of the present invention as described above also lends itself to a method of use for both transport and display of articles contained therein. In accordance with the preceding description, it is important according to the present invention that the carton be essentially display-ready during transport and particularly upon arrival at a point of sale. Such a method which is also contemplated by the present invention is described in greater detail below.

Initially, a carton such as that indicated at either 10 or 10' is formed in accordance with the preceding description preferably from a wrap 28 and two end pieces 54 and 56. The method described below can be used with either of the cartons 10 or 10'. However, for convenience, it is described below only with reference to the carton 10 and it is to be understood that the description of the method also applies to the other carton 10' as well as additional cartons formed according to the invention.

With the carton 10 formed from the wrap 28 and end pieces 54 and 56, it is arranged as illustrated in FIG. 3 with its top panel 20 being open for receiving the articles 94. It is also to be noted that the carton may also be employed for transporting empty articles prior to their being filled with liquid. However, for purposes of the present invention, it is contemplated that the top panel 20 of the carton preferably remains open until the articles 94 are filled and arranged therein as illustrated in FIG. 3.

During the steps described above, the removable reinforcing element 16 serves to structurally stabilize and rigidify the carton, particularly the front panel 14.

At this point, the carton 10 is essentially ready for transport except for closing of the flaps 34, 36 and minor flaps 60 on the end pieces to form the top panel 20.

The invention preferably contemplates that the reinforcing element 16 be removed after the carton 10 is filled with the articles 94 and after the top panel 20 is closed and glued. However, in some instances, it may be desirable to leave the reinforcing element 16 in place within the opening 12 until the carton 10 has arrived at a selected point of sale (not illustrated). Accordingly, the invention contemplates the carton 10 as being display-ready during transport regardless of whether the reinforcing element 16 is removed prior to or after transport or even at some time therebetween.

The carton is further conditioned for transport by arranging the carton 10 and a number of other cartons of similar construction on a pallet preferably suitable for use both during transport and display.

Referring to FIG. 7, a large number of cartons 10' are illustrated in stacked arrangement upon a pallet 96. For purposes of the present method, the stacked arrangement of cartons 10' on the pallet 96 in FIG. 7 represent both transport and display modes according to the present invention.

After the cartons are initially stacked upon the pallet, they are preferably secured in place, for example, by means of bands or stretch-wrap (not shown) merely to stabilize the cartons and retain them in place upon the pallet.

With the pallet configured in this manner as illustrated in FIG. 7, it is then transported to a point of sale which preferably is a warehouse club type operation or the like.

At the point of sale, the pallet 96 is also employed as part of the display with the cartons 10' remaining in place thereon. The stack of cartons 10' on the pallet is prepared for display merely by removing the bands or stretch-wrap which serve to secure and/or stabilize the cartons in place upon the pallet during transport. As noted above, the reinforcing element 16 or 16' could optionally be removed from the cartons at this time, just prior to display. However, with the reinforcing elements 16 or 16' preferably being removed prior to transport, the cartons 10' are fully display-ready upon arrival at the point of sale upon the pallet 96, at least after the securing bands or wrap is removed.

Thus, there has been described above at least two embodiments of construction for a display-ready carton and its method of use according to the present invention. Various modifications in addition to those specifically noted above are also contemplated by the present invention. In particular, it is noted that the cartons 10 and 10' were preferably formed from a single wrap such as that indicated at 28 and two similar end pieces 54 and 56. However, the formation of the carton in this manner was preferably selected for the purpose of adapting the carton for use on existing machines designed for use with cartons formed from three similar elements.

Otherwise, the invention also contemplates other methods of construction for the carton. In particular, it would also be possible to form all of the preceding elements for the carton from a single blank. Here again, formation of the carton from three elements including a wrap and two end pieces is preferred because of the reduced waste in corrugated material. By comparison, formation of the carton components from a single blank would result in possibly greater waste of corrugated material. However, such a construction is contemplated by the present invention to the extent that it may offer advantages offsetting the use of additional corrugated material. It is further noted that the single blank for the carton could include features such as the triangular supports contemplated in the vertical corners of the carton. The invention also contemplates a more conventional container with a similar opening and reinforcing element and possibly separate reinforcing inserts in place of the triangular supports formed by the end pieces.

Accordingly, the present invention contemplates all variations as described above and as defined by the following claims which are accordingly further exemplary of the invention.

What is claimed is:

1. A packing carton of a type including a wrap integrally forming a bottom panel, front and back panels, and a top panel, and two separate end pieces interconnected with the wrap to form two end panels for the packing carton, the carton being "display-ready" during transport and comprising an opening formed in the front panel to display articles contained within the carton and to permit removal of the articles from the carton as desired, the opening being sufficiently large to permit display and removal of the articles, the wrap being formed from corrugated material having a horizontal axis of corrugation parallel to fold lines between the bottom panel and respective front and back panels, and the two end pieces each being formed from corrugated material having a vertical axis of corrugation parallel to vertical corners of the carton formed from the wrap and two end pieces, the front panel including an element removably extending across the opening to facilitate forming and filling of the carton, the removable element being removable at least during display to facilitate display of the articles in the carton and removal of articles from the carton as desired.

2. The display-ready packing carton of claim 1 wherein the opening extends into the top panel of the wrap, the removable element including a horizontally extending bar portion and a bar portion extending vertically through the opening in the front panel and continuing through the opening extending into the top panel.

3. A packing carton of a type including a wrap integrally forming a bottom panel, front and back panels, and a top panel, and two separate end pieces interconnected with the wrap to form two end panels for the packing carton, the carton being "display-ready" during transport and comprising an opening formed in the front panel to display articles contained within the carton and to permit removal of the articles from the carton as desired, the opening extending into the top panel of the wrap, the opening extension in the top panel being at least large enough to permit sequential removal of the articles from the carton, the wrap being formed from corrugated material having a horizontal axis of corrugation parallel to fold lines between the bottom panel and respective front and back panels, and the two end pieces each being formed from corrugated material having a vertical axis of corrugation parallel to vertical corners of the carton formed from the wrap and two end pieces.

4. A packing carton of a type including a wrap integrally forming a bottom panel, front and back panels, and a top panel, and two separate end pieces interconnected with the wrap to form two end panels for the packing carton, the carton being "display-ready" during transport and comprising an opening formed in the front panel to display articles contained within the carton and to permit removal of the articles from the carton as desired, the opening being sufficiently large to permit display and removal of the articles, the wrap being formed from corrugated material having a horizontal axis of corrugation parallel to fold lines between the bottom panel and respective front and back panels, and the two end pieces each being formed from corrugated material having a vertical axis of corrugation parallel to vertical corners of the carton formed from the wrap and two end pieces, the front panel forming lateral end portions on each horizontal side of the opening for interconnection to the end pieces and a bottom portion extending laterally below the opening to form an integral fold in the wrap together with the bottom panel, the top panel means of the wrap including major flaps arranged to overlap and form a top panel for the carton, the end pieces including minor flaps for forming triangular structures extending between the top and bottom panels in four vertical corners of the carton, the lateral end portions of the front panel interconnecting with the respective triangular structures in two adjacent of the vertical corners of the carton.

5. The display-ready packing carton of claim 4 wherein the carton has an interior vertical height substantially similar to height of the articles whereby the articles-enhance stacking strength of the carton.

6. A packing carton of a type including a wrap integrally forming a bottom panel, front and back panels, and a top panel, and two separate end pieces interconnected with the wrap to form two end panels for the packing carton, the carton being "display-ready" during transport and comprising an opening formed in the front panel to display articles contained within the carton and to permit removal of the articles from the carton as desired, the opening being sufficiently large to permit display and removal of the articles, the wrap being formed from corrugated material having a horizontal axis of corrugation parallel to fold lines between the bottom panel and respective front and back panels, and the two end pieces each being formed from corrugated material having a vertical axis of corrugation parallel to vertical corners of the carton formed from the wrap and two end pieces, the top panel of the wrap including major flaps arranged to overlap and form the top panel for the carton, the end pieces including tabs for forming triangular structures extending between the top and bottom panels in four vertical corners of the carton.

7. The display-ready packing carton of claim 6 wherein the carton has an interior vertical height substantially similar to height of the articles whereby the articles enhance stacking strength of the carton.

8. A display ready carton suitable for both transport and display of articles in the carton, comprising vertical end panels, vertical front and back panels, top and bottom panels, triangular means arranged in each of four vertically extending corners formed by two adjacent of the vertical panels to provide structural rigidity, and one of the vertical panels forming a central opening sufficiently large for displaying and permitting removal of the articles and end portions on both lateral sides of the opening for respective interconnection with two of the triangular means in order to enhance structural rigidity whereby the carton is suitable for transport in a display-ready condition while facilitating subsequent display of the articles within the carton and removal of the articles from the carton as desired by means of the opening.

9. The display-ready carton of claim 8 wherein the one vertical panel further forms a bottom portion extending laterally below the opening to form an integral fold with the bottom panel.

10. The display-ready carton of claim 9 wherein the one vertical panel includes an element removably extending across the opening to facilitate filling of the carton, the removable element being removable at least during display to facilitate display of articles in the carton and removal of articles from the carton as desired.

11. The display-ready carton of claim 10 wherein the opening extends into the top panel, the removable element including a horizontally extending bar portion and a bar portion extending vertically through the opening in the front panel and continuing through the opening extending into the top panel.

12. The display-ready carton of claim 9 wherein the vertical front and back panels and the bottom panel are formed by an integral wrap having major flaps arranged to overlap and form the top panel, the vertical end panels being formed by separate end pieces including means for interconnection to the wrap, each end piece integrally including two of the triangular means.

13. The display-ready carton of claim 12 wherein the wrap and end pieces are formed from corrugated material, the corrugated material in the wrap having a horizontal axis of corrugation parallel to fold lines between the bottom panel and vertical front and back panels, the corrugated material in the two end pieces having a vertical axis of corrugation parallel to vertical corners of the carton formed from the wrap and two end pieces.

14. The display-ready carton of claim 9 wherein the carton has an interior vertical height substantially similar to height of the articles whereby the articles enhance stacking strength of the carton.

15. The display-ready carton of claim 9 wherein the carton is formed from corrugated material having an axis of corrugation extending horizontally through the one vertical panel and extending vertically through the two end panels to enhance structural rigidity of the carton.

16. A display-ready carton suitable for both transport and display of articles in the carton, comprising vertical end panels, vertical front and back panels, and top and bottom panels, one of the vertical panels forming a central opening sufficiently large for displaying and facilitating removal of the articles, end portions on both lateral sides of the opening and bottom portion extending laterally below the opening to form an integral fold with the bottom panel, the one vertical panel including an element removably extending across the opening to facilitate filling of the carton, the removable element being removable at least during display to facilitate display of the articles in the carton and removal of the articles from the carton as desired.

the carton being formed from corrugated material having an axis of corrugation extending horizontally through the one vertical panel and vertically through the two end portions in order to enhance structural rigidity, whereby the carton is suitable for transport in a display-ready mode while facilitating subsequent display of the articles within the carton and removal of the articles from the carton as desired by means of the opening.

17. The display-ready carton of claim 16 wherein the opening extends into the top panel, the removable element including a horizontally extending bar portion and a bar portion extending vertically through the opening in the front panel and in the top panel.

* * * * *